United States Patent [19]

Pecka et al.

[11] 4,071,218

[45] Jan. 31, 1978

[54] CAN MOUNTING CLIP

[76] Inventors: Richard D. Pecka, 1702 Harding Road, Northfield, Ill. 60093; Raymond J. Templin, 2805 Henzada, McHenry, Ill. 60050

[21] Appl. No.: 661,429

[22] Filed: Feb. 26, 1976

[51] Int. Cl.[2] ..... A47K 1/08

[52] U.S. Cl. ..... 248/221.4; 248/316 C; 248/311.1 A

[58] Field of Search ..... 248/313, 316 C, 316 D, 248/301, 305, DIG. 3; 211/72, 73; 24/255 R, 255 AS, 255 TV, 255 S

[56] References Cited

U.S. PATENT DOCUMENTS

| | | | |
|---|---|---|---|
| 2,711,873 | 6/1955 | Larin | 211/73 |
| 2,764,384 | 9/1956 | Kirsch | 248/313 |
| 2,823,004 | 2/1958 | Melloh | 248/305 |
| 3,154,281 | 10/1964 | Frank | 248/201 |
| 3,155,360 | 11/1964 | Cassells | 248/313 |
| 3,193,234 | 7/1965 | Thurman et al. | 248/313 |

*Primary Examiner*—Robert A. Hafer

*Attorney, Agent, or Firm*—Dominik, Knechtel, Godula & Demeur

[57] ABSTRACT

A plastic can clip for engaging the top chine of cans, particularly beer cans for decorative display. The clip has a capture space between front, top and rear walls, and a lip extending from the bottom of the rear wall towards the front wall to define a mouth into the capture space. An offset bracket extends from the rear wall, and has means for mounting to a support so that the rear wall is spaced from said support, thereby leading to improved suspension of the can which tilts backwardly so that the bottom chine contacts the support. Such can clips can be selectively mounted to a support, removably or affixed to the support, and one or more of such clips can be mounted to decorative supports such as plaques.

5 Claims, 8 Drawing Figures

CAN MOUNTING CLIP

FIELD OF THE INVENTION

This invention relates to can clips which are mounted to a support, such can clips removably receiving cans for mounting in a decorative manner or in a utilitarian manner. In particular, the invention relates to plastic can clips having means for mounting to a support, and means for quickly and reliably receiving the top chine of the can in hanging relationship.

DISCUSSION OF RELATIVE ART

Applicant has found prior art in which plastic members are formed to hold a group of cans in ganged relationship, such as six-pack beer cans. These include plastic members which span the number of cans and have other plastic members for engaging the top chines of beer cans. Examples of such art include U.S. Pat. No. 3,480,136 in which a holding plastic member has a channel for engaging a chine; U.S. Pat. Nos. 3,184,260 and 3,357,551 which additionally include the lip type elements to engage the underside of the top chine.

Such teachings do not suggest nor are adapted for holding cans in hanging relationship relative to a support for purposes of decoration or utility. Clearly, such teachings do not suggest the advances necessary in such structures to be utilized for such purposes.

OBJECTS AND ADVANTAGES OF THE INVENTION

It is one object of the present invention to provide can clips formed of plastic having improved features for mounting such clips to supports in such a manner that cans can be quickly and securely received in hanging relationship relative to such supports.

It is another object and advantage that such can clip can be quickly and reliably mounted to supports so that cans can be reliably and interchangeably held for decorative purposes, such as empty beer cans. It is an additional feature of this object that filled cans can be mounted to such clips, in a similar manner, to realize utilities of storage, the cans being quickly mounted, securely held in hanging relationship, and quickly demounted when desired.

It is still yet another object and advantage of the present invention to provide can clips which may be removably mounted or affixed to decorative surfaces such as plaques, or the like, so that beer cans may be attractively displayed, such cans further being quickly interchanged or replaced on the decorative support in accordance with desires of the practitioner.

DESCRIPTION OF THE VIEWS IN THE DRAWINGS

SUMMARY OF THE INVENTION

A plastic can clip defines a capture space between top, front and rear walls, the top chine of a can held within such capture space with the aid of a lip that engages the bottom of the top chine. The front wall of the plastic clip is displaceable towards and away from the rear wall to vary the dimensions of a mouth between the lip and the bottom of the front wall. This allows the top chine of a can to move through the mouth into the capture space, the displaced front wall having plastic memory so it resumes its normal nondisplaced position to hold the top chine in the capture space.

The rear wall of the plastic clip has a bracket member which can extend above the top wall or, alternatively, below the mouth leading into the capture space. This bracket member is offset relative to the rear wall so that the rear wall is spaced away from an upright support when the bracket member contacts such support in mounting relationship. The bracket member is variously mounted to the support, as by use of a fastener through a mounting aperture, bonding to the support by bonding materials or sonic heat seal, or the like. The plastic can clip can also be integrally molded with a support that is part of a decorative or utilitarian assembly.

The offset bracket member allows the bottom of the can to tilt backwardly towards the support so that the can preferentially has two contact points. One contact point is the top chine held within the capture space, and the other contact point is the bottom chine which contacts the support. This provides more stability to the can held in hanging relationship relative to a support. In this respect, it has been found that the improved plastic can clips can advantageously hold unopened cans with their contents, reliably and safely. This allows utilitarian use in storage of canned food stuffs against a cabinet door or wall, for example. It also provides utilitarian storage of liquids, such as in a workshop. Additionally, it can be used for commercial displays, as in stores.

Particular advantage is realized from using such clips for decoratively displaying empty beer cans in that such cans are attractively displayed and, additionally, may be selectively interchanged or replaced on a particular support, decorative or otherwise.

DETAILED DESCRIPTION OF THE INVENTION

Figure 1:
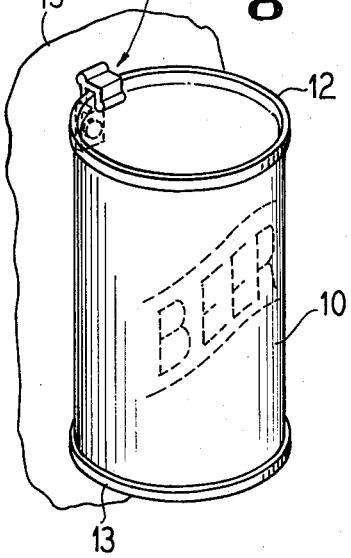
FIG. 1 is a perspective view illustrating the plastic can clip mounted to a support and holding a beer can in decorative display.

FIG. 1 shows an empty beer can 10 with a continuous top chine and a continuous bottom chine 13. The can is held by a plastic clip shown generally as 14, which clip is mounted to an upright support 15 having a substantially planar support surface, shown fragmentarily.

Figure 2:
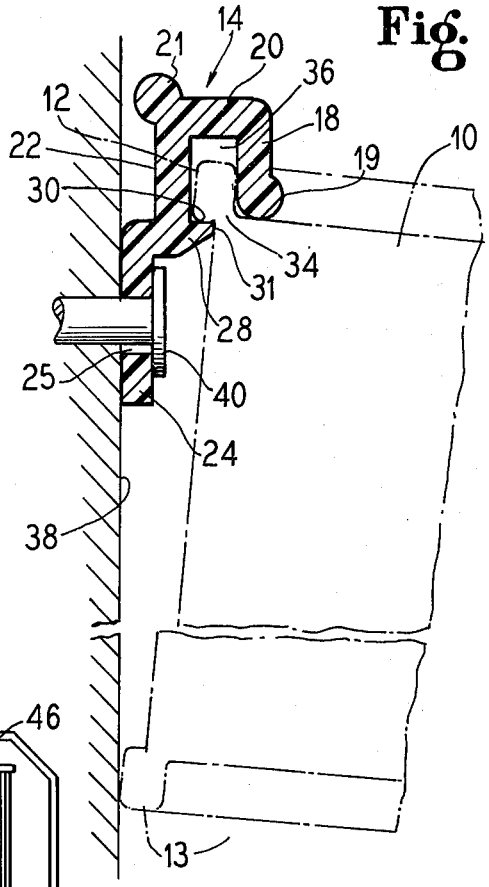
FIG. 2 is a side elevational view, mostly in section and on an enlarged scale, illustrating a can held in hanging relationship.
Figure 3:
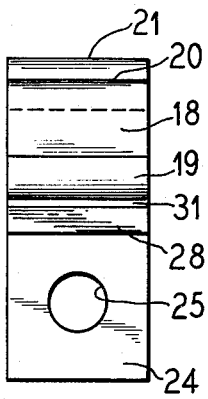
FIG. 3 is a front elevational view of the plastic can clip, on a scale similar to that of FIG. 2.

Looking particularly at FIG. 2, the plastic clip is shown with the front wall having a bottom bead 19; a top wall 20 with a corner bead 21; and a rear wall 22. The beads are formed during the molding process, and additionally impart strength at their locations to the clip.

An offset bracket member 24 is shown joined to the rear wall 22, and said bracket member is shown extending downwardly below the bottom of the rear wall.

A lip member 28 projects from the bottom of the rear wall towards the front wall of the plastic clip. The lip has a flat or shoulder 30, the plane whereof is parallel to the longitudinal axis of the top wall 20. The lip additionally has a face, the plane whereof is in normal relationship to the longitudinal axis of said top wall.

The lip and the bead at the bottom of the front wall define a mouth 34 which normally has a dimension smaller than the thickness of the top chine 12 of the can. The mouth opens into a capture space 36 which is defined by the walls of the plastic clip.

The front wall 18 is displaceable, and is moved away from the rear wall as the top chine moves through the mouth 34. Once the chine is within the capture space 36, the front wall 18 resumes its normal position relative to the rear wall, and the shoulder 30 of the lip is below the top chine while the face 31 abuts against the continuous wall of the beer can 10.

Figure 4:
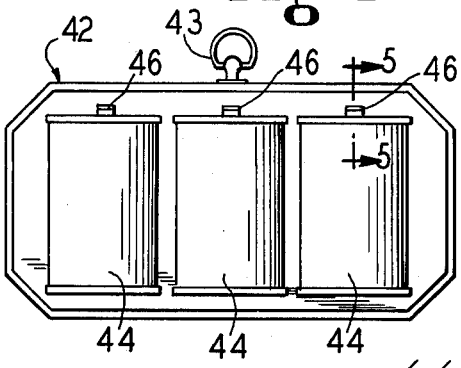
FIG. 4 is a front elevational view of a decorative plaque having the mounted plastic can clips holding cans in decorative display, on a reduced scale relative to the foregoing figures.
Figure 5:
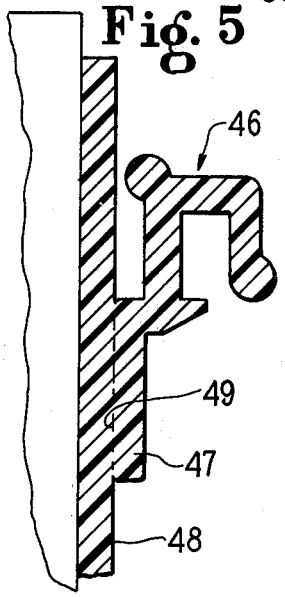
FIG. 5 is a sectional view taken along line 5—5 of FIG. 4, but on an enlarged scale and with portions removed for purposes of clarity.

The offset bracket member 24 is shown contacting a support 38, which may be a board, a wall, or the like. A fastener shown as a nail 40 passes through the mounting aperture 25 of the offset bracket member and is secured to the support 38. FIG. 4 illustrates the support as being decorative and part of a plaque shown generally as 42. Such plaque is shown with an eyelet hanger 43, and a plurality of empty beer cans 44 are shown mounted in hanging relationship, each to a plastic clip shown generally as 46. In FIG. 5, such clip is shown with its offset bracket member 47 affixed to a support surface 48 of the plaque by a permanent bonding point indicated at 49. This may be adhesive, sonic heat sealing, heat sealing, integral molding, or other securing means. It will be seen that the cans 44 can be removed and replaced by other cans to achieve particular esthetic grouping or individual displays. The same cans can be interchanged in grouping, or be replaced by other cans by quick and simple withdrawal of the top chine from the capture space of the plastic clips, followed by reintroduction of a top chine of another can in such capture space.

Figure 6:
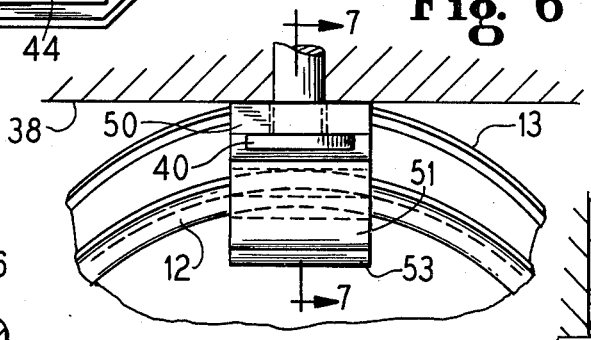
FIG. 6 is a portional top plan view on a scale equivalent to that of FIG. 2, illustrating the plastic clip holding a can in hanging relationship.
Figure 7:
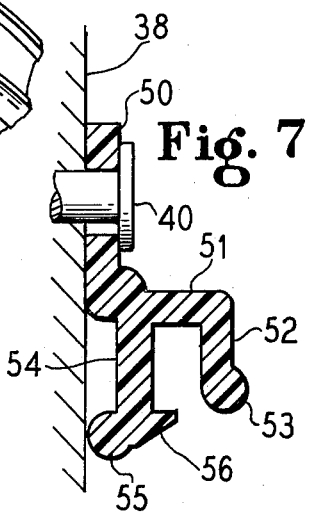
FIG. 7 is a sectional view taken along line 7—7 of FIG. 6, showing in greater detail an alternative embodiment of the plastic can clip.

Looking now at FIGS. 6 and 7, there is shown a plastic can clip in which an upper offset bracket member 50 is shown extending above a top wall 51. Such clip otherwise has a displaceable front wall 52 with its bead 53, and a rear wall 54 with bead 55 and lip 56. It is seen that bead 55 is generally aligned with the support contacting surface of the offset upper bracket arm 50, to thereby prevent shifting of the capture space towards the support 38. The upper offset bracket arm leads to advantages in visually appraising the can held in the clip relative to the support, prior to applying the fastener 40. Other advantages may occur to practitioners from this alternative embodiment.

Figure 8:
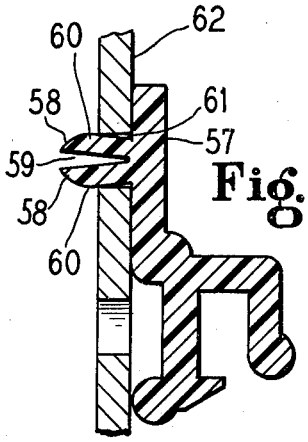
FIG. 8 is a side elevational view in section of an alternative embodiment of the plastic can clip, showing a support member in portional view.

The alternative embodiment shown in FIG. 8 has the upper offset bracket member 57, and fastener means integrally molded to such bracket member. The fastener means are shown as a pair of resilient finger means 58 which are movable towards each other in the space or gap 59, but which have memory to resume their normally spaced apart relationship. Each of the fingers has a protuberance 60, which together, provide a dimension greater than the diameter of board opening 61 in peg board 62. Moving the resilient fingers 58 together reduces the dimension defined by the protuberances so that the fastening means may be moved through the board opening 61, the released fingers thereafter moving apart to hold the plastic clip to the board.

It is seen that the improved can clip allows mounting to a support so that when the bracket member contacts the support the rear wall of the plastic clip is spaced away from said support. This contributes to the advantages of backward tilt of the hanging can, thereby leading to greater stability in the hanging relationship relative to the support. The spacing of the rear wall from the support is aided by providing the molded beads at the rear wall which are generally aligned with the offset bracket member. It will be appreciated that the bracket member can be provided in a form which is not offset relative to the rear wall, but this does not lead to the advantages which were described for the plastic clip having the offset bracket. In certain embodiments, a bracket member can be eliminated and the rear wall can be bonded directly to the support or be integrally molded with such a support. The angle of the tilting can at the bottom with the support will, however, be substantially reduced; and this will detract from the desired two point stability.

The claims of the invention are now presented and the terms of such claims will be better understood by reference to the language of the preceding specification and the views of the drawings.

What is claimed is:

1. A plastic clip for engaging the top chine of a can in hanging relationship when said clip is mounted to an upright support, said clip including a rear wall, a top wall, a front wall spaced from the rear wall by said top wall and displaceable relative to the rear wall, but having memory of its nondisplaced position, a capture space for the top chine of a can formed by the top, rear and front walls, said capture space having a dimension between the front and rear walls in nondisplaced condition which is substantially the same as the thickness of the top chine, and the capture space having a height between the shoulder and the top wall which is greater than the height of the top chine of a can, a lip at the bottom of the rear wall extending toward the front wall and defining a mouth normally of smaller dimension than the top chine of a can, said lip having a shoulder which lies in a plane parallel to the longitudinal axis of the top wall and a face boring in a plane normal to said top wall said shoulder supporting the bottom of a top chine positioned in the capture space, and said face of said shoulder abutting the continuous wall of a can, when positioned therein a bracket extending from the rear wall, the top and bottom of said rear wall having beads formed integrally therewith during the molding process, said beads spacing the rear wall from the upright support so a bottom chine of a can contacts the upright support, and means for mounting the bracket to the front of an upright support such that the top chine clears the lip and is within the capture space, whereupon the memory returns the front wall to its nondisplaced position.

2. A plastic clip which includes the features of claim 1 wherein said bracket is joined to the bottom of the rear wall and extends below the mouth of the clip.

3. A plastic clip which includes the features of claim 1 wherein said bracket is joined to the top of the rear wall and extends beyond the top wall.

4. A plastic clip which includes the features of claim 1 wherein said bracket has a mounting aperture to receive a fastener to hold the clip to a support.

5. A plastic clip which includes the features of claim 1 wherein said bracket includes integrally molded resilient fingers for mounting to a hole in a support.

* * * * *